United States Patent [19]

Fabiano et al.

[11] Patent Number: 5,021,780

[45] Date of Patent: Jun. 4, 1991

[54] BUS PASSENGER ALERTING SYSTEM

[75] Inventors: Richard F. Fabiano, 6629 Denham Court, SE., Grand Rapids, Mich. 49546; Robert W. Houskamp, Grand Rapids, Mich.

[73] Assignee: Richard F. Fabiano, Grand Rapids, Mich.

[21] Appl. No.: 414,537

[22] Filed: Sep. 29, 1989

[51] Int. Cl.[5] ..... G08G 1/12

[52] U.S. Cl. ..... 340/994; 340/539; 340/991; 364/436

[58] Field of Search ..... 340/991-994, 340/988, 996, 539; 180/168; 342/457; 364/436, 460; 455/49, 99; 370/85.8

[56] References Cited

U.S. PATENT DOCUMENTS

| | | | |
|---|---|---|---|
| 3,560,916 | 2/1971 | Buckingham et al. . | |
| 4,297,672 | 10/1981 | Fruchey et al. | 340/994 |
| 4,325,057 | 4/1982 | Bishop | 340/539 |
| 4,350,969 | 9/1982 | Greer . | |
| 4,713,661 | 12/1987 | Boone et al. | 340/994 |
| 4,809,257 | 2/1989 | Gantenbein et al. | 370/4 |
| 4,857,886 | 8/1989 | Crews | 340/323 R |

*Primary Examiner*—Joseph A. Orsino, Jr.
*Assistant Examiner*—Brent A. Swarthout
*Attorney, Agent, or Firm*—Price, Heneveld, Cooper, DeWitt & Litton

[57] ABSTRACT

A system for alerting passengers, particularly school children, that the particular bus they are to board is approaching. The passengers have a receiver which senses the particular signal transmitted by the approaching bus. The passengers listen for and/or watch for a visual indication that the bus is now at the location on its route where preparations should be made for boarding. The bus carries a transmitter which sends out a specific signal identifying that bus. The signal is derived from data which was entered into a signal generator in the transmitter relating to the particular school district, the route to be traveled by the bus, and the number of the bus. Each residence where the school children are waiting has a receiver which will activate an indicating device only when the specific bus identification signal is received.

3 Claims, 4 Drawing Sheets

10
FM GATE
VCC
VPP
D1
D2
D3
D4
D5
D6
D7
D8
D9
VSS
RS
CTC
RTC
EN
220K
.01
43K
ENABLE DECODER
BIT 0
INVALID CODE
COUNTER OFFSET
A
B
10K
10K
VCC
27
29
31
25
O0
O1
O2
O3
O4
O5
O6
O7
VSS
CE
OE
A12
A13
A14
VDO
VPP
VCC
A7
A6
A5
A4
A3
A2
A1
A0
A8
A9
A10
A11
VCC
VCC
17
19
21
VCC
11
13
15
OFF
OFF

BUS PASSENGER ALERTING SYSTEM

BACKGROUND OF THE INVENTION

The present invention relates to a system for alerting passengers, particularly school children, of the impending arrival of a school bus.

In a rural area, a school bus travels many miles in picking up students along its particular route. The students to be picked up can live in a diverse range of homes. Some students live close together and in turn can cluster at a common bus stop while others live away from the road, in fact sometimes so far away that the road cannot be seen. In either situation it would be desirable if the children could know in advance that the school bus was approaching and have time to gather their belongings before journeying to the bus stop or to the road where the bus will stop. During the winter and in rainy weather it would be particularly desirable for the students to know with a reasonable degree of certainty of the time when the bus will arrive so that they will have time to dress for the weather before starting out. Also, since school buses all too commonly become stuck in snow or ice along the bus route, the students would not have to wait an undue period of time for the bus, not knowing when or if it will arrive.

Parents in school systems have been aware of this problem for some time and have attempted to solve it by equipping the school buses with transmitters which would send out a signal which could be received in the home to alert the school children. While this appears to be an easy solution to the problem, it has been anything but that. Many of the proposed systems have been far too complicated and in turn too expensive to be practical. Also, the receivers in the home were too complicated, or subject to being incorrectly adjusted, so that the signal was either not received or not received early enough to give the children time to prepare to leave for the bus.

In U.S. Pat. No. 3,560,916, issued to Buckingham et al. Feb. 12, 1966, a transmitter is provided on the bus having a frequency-determining element which was controlled by the odometer cable. As the bus traveled along the route incremental changes in the odometer reading caused the transmitted signal to increase in frequency by a predetermined amount. Each home along the route had a receiver with a precisely tuned circuit which could recognize the particular frequency corresponding to the position of the bus at that time or at the time needed to provide warning for the school children to prepare to leave to meet the bus. Both the transmitter and receiver in this system were extremely complicated and expensive which caused the system to not be accepted.

In U.S. Pat. No. 4,325,057, issued to Bishop on Apr. 13, 1982, a school bus approach system was disclosed in which the bus transmits a signal on a frequency corresponding to the route that the bus would travel. The home would have a receiver capable of receiving this signal and alerting the school children of the pending arrival of the bus. The bus driver could select through a switch the particular frequency the transmitter would send on, corresponding to the route the bus would travel. A receiver was provided for each home along that particular route which was capable of detecting the particular signal sent by the bus. The receiver at the home had a sensitivity control to be used to adjust the receiver so that it would only emit a warning signal when the bus was at a particular distance from the home which would provide the children with sufficient time to prepare to board the bus. Since the sensitivity control determined the point when the receiver would activate visual or audible alarm alerting the students of the approach of the bus, the sensitivity control became a source of error. If the sensitivity control was adjusted improperly so that it required too strong a signal, then the bus would be too close to the home before the receiver would become activated. On the other hand, if the control was set so that the receiver was too sensitive, then the purpose of the system was defeated since the children would prepare and expose themselves to inclement weather for an unnecessarily long time before the bus arrived.

Another serious deficiency in the Bishop system was that the bus was limited in the number of frequencies upon which it could transmit a signal. Both the receiver and transmitter were crystal controlled and only a small number of frequencies were available for use. Also, the patent provides no teaching as to how students of different ages or in different grades in the same school could differentiate between buses traveling on the same route. The distinguishing feature was the bus route and not a signal specific to each bus.

SUMMARY OF THE INVENTION

In accordance with the present invention, a system is provided for identifying each bus with a unique signal which can easily be encoded into the transmitter. The three primary variables in any school bus system are the school district, which is used here as a collective term for county, township, parish, etc.; the route identification information; and the bus identification information, usually just the number. Each of these three variables are used to provide an input to a signal generated in the transmitter which results in a unique transmitted signal which specifically identifies the particular bus. The receivers distributed to the school children who would ride this bus are also preadjusted to receive only this unique signal. The receiver is also only provided with an on and off control so that there is little chance of a misadjustment providing too early an alarm or no alarm.

In accordance with the present invention a system is provided for alerting a passenger that a particular bus is approaching. A transmitter is mounted in each bus for transmitting a signal specifically identifying that bus. The transmitter has a set of switches for entering the district, the route and the bus identification information. A signal generator in each transmitter uses the inputted data to generate a unique signal which specifically identifies that bus. A receiver is provided for each home along the route which is responsive to the particular signal transmitted by the bus. When the receiver senses the signal it activates an audible and/or visual alarm which advises the passengers that the bus is approaching and that preparations should be made for boarding the bus.

DETAILED DESCRIPTION OF THE PREFERRED EMBODIMENTS

Figure 1:
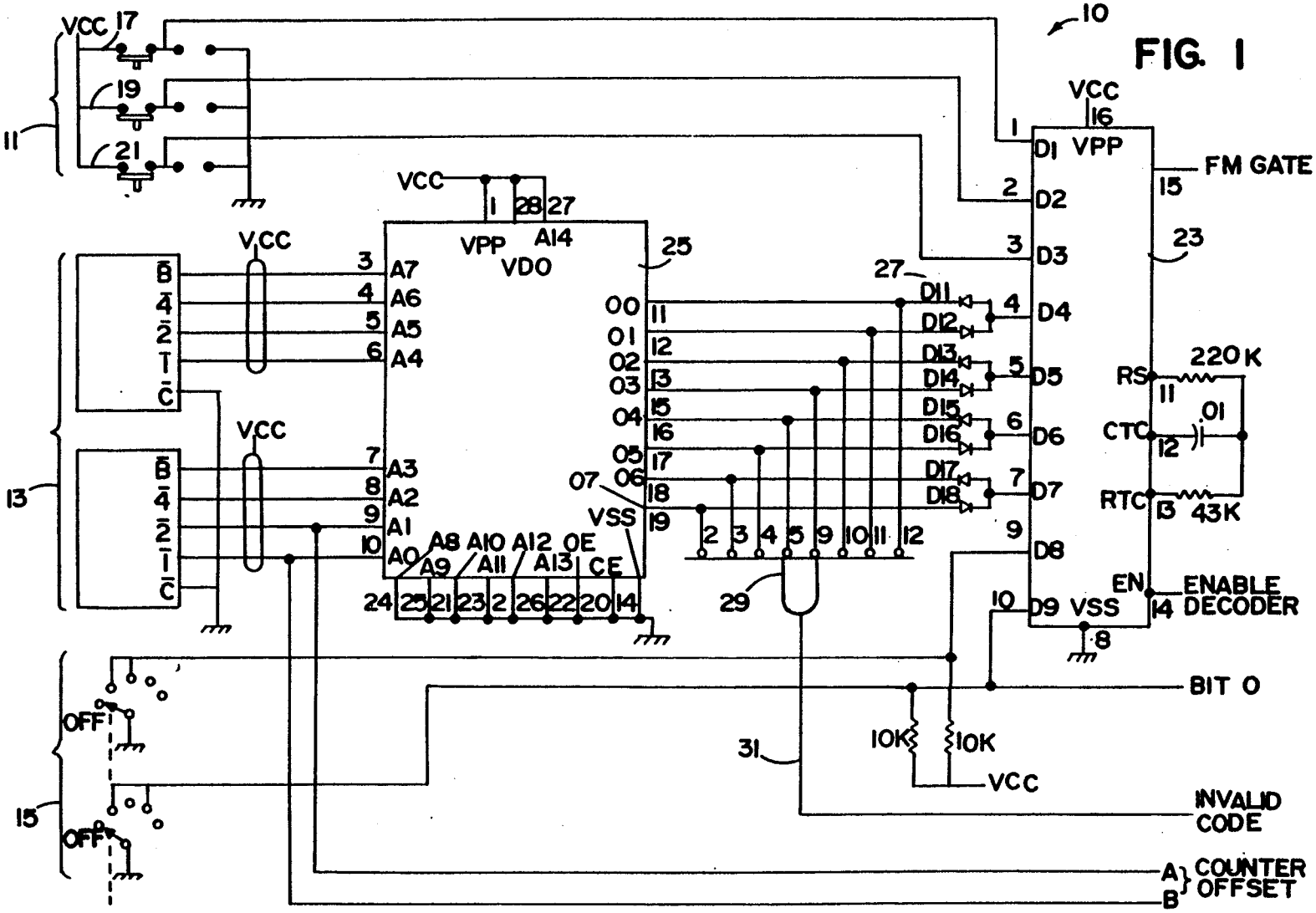
FIG. 1 is a block diagram of the signal generator portion of the transmitter.

Referring to FIG. 1, the signal generator portion of the transmitter is shown and indicated generally by the number 10. The signal generator has three sources of variable input data. These are the district switches 11, the bus information or bus number switches 13, and the bus route switches 15. In order to simplify the operation of the transmitter, since the district switches are usually set only once, these switches are placed internal to the transmitter cabinet. The district switches 11 are three position slide switches 17, 19 and 21. These three slide switches provide for 27 districts. Slide switch 17 is used to connect pin D1 of the encoder chip 23 to Vcc, to a center or open position and to a third position where pin D1 is grounded. Slide switches 19 and 21 perform the same switching for pins D2 and D3 of the encoder chip The decoder chip 23 is a standard Motorola MC145026T chip. The chip has a 9-wire input and a single wire output. The input and output have not been referred to as a 9-bit input and a single bit output as the chip is used in a tri-state mode. As seen above in the description of the district switches 11, pins D1, D2 and D3 can either be connected to supply voltage Vcc, they can be open in the center position or grounded in the third position. Having the ability to encode the chips at three levels has substantially increased the available output signals. With a 9 bit input to the encoder one would expect $2^9$ or 512 combinations. Using the tri-state encoding, with the exception that the last wire D9 will only recognize two states, the total number of unique codes is $3^8 \times 2$ or 13,122. It can be seen that without using extremely complicated circuitry or large size integrated circuit chips the compact signal generator of the present invention can produce over 13,000 useful signals where one would normally expect to obtain only 512.

The bus route is encoded into the signal generator through a simple rotary switch having two wafers. The rotary switch is shown in the off position. When it is moved to the 1 position, pin D8 of encoder chip 23 is brought to the low condition. In step position 2 it is held low while in positions 3 and 4 D8 is high. Pin D9 is low at the first position, high at the second, low at the third, and high at the fourth. As currently wired in the preferred embodiment, the bus route switch enables the selection of any one of four possible routes.

The next variable to be selected is the bus information or bus number switch 13. The switches 13 enable a bus number from 1 to 80 to be entered into the signal generator. Two push-button switches are used which provide a binary coded decimal output each on four lines to the bus number translation ROM 25. The ROM 25 provides 8 outputs to a diode matrix 27 which reduces the 8 outputs to 4 which are applied to the encoder chip 23. It can be seen then that the district switches 11 provide three inputs to the encoder chip. The bus number switches 13 provide four inputs and the bus route switches 15 provide two inputs, or a total of 9 inputs to the encoder chip. The encoder chip provides an output on pin 15 which is used for the preferred frequency modulation of the transmitter. Other modulation techniques can also be used such as amplitude modulation, phase and pulse modulation.

In coding the bus number switches, the range of buses was set at 1–80. Obviously the switches can go as high as 99 so the states 00 and from 81–99 were made invalid states. When any of these invalid bus numbers were entered into the bus number switches 13, the output of the translation ROM 25 was taken off through a logic gate 29 and applied to a conductor 31 where it can be sent to actuate an invalid code alarm.

Figure 2:
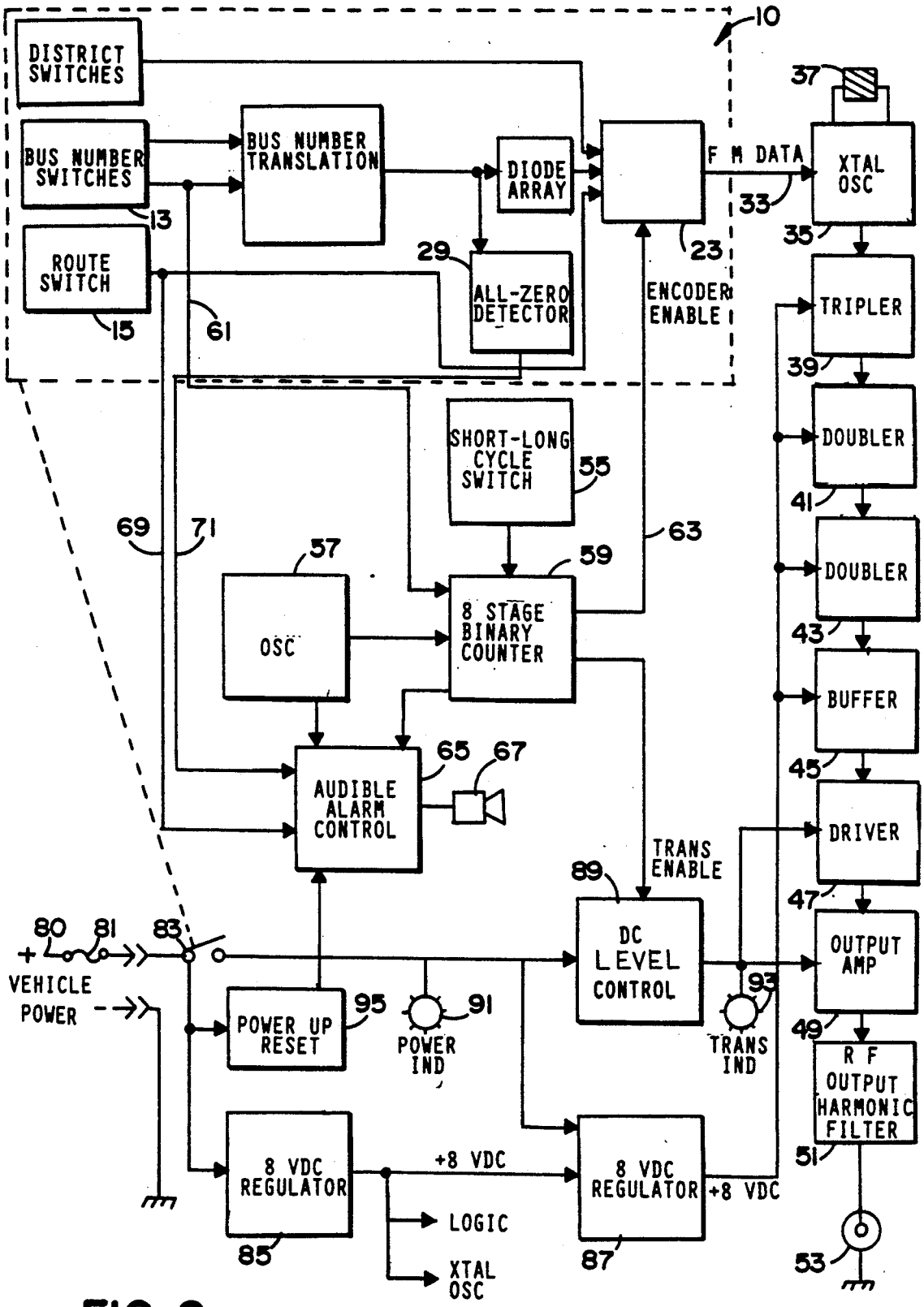
FIG. 2 is a block diagram of the transmitter incorporating the signal generator of FIG. 1.

Now referring to FIG. 2, the signal generating portion 10 of the transmitter can be seen occupying the upper left-hand portion of the block diagram. The output of the signal generator 33 is applied to an oscillator 35 whose frequency is controlled by a crystal 37. The information on line 33 is used to frequency modulate the oscillator 35. The output of the oscillator is then fed through a tripling stage 39, a doubler 41, a second doubler 43, and a buffer 45 to an amplifier driver 47 which drives the output amplifier 49. The output of the amplifier 49 is then fed through an output harmonic filter 51 to an output connector 53 mounted on the transmitter cabinet. The output of the transmitter is at 154.570 MHz at 2 watts. The signal is uniquely encoded with the information from the signal generator 10. The transmitter block diagram is representative of a typical transmitter and is not meant to limit the invention in any way.

When many buses are operating in the same area and have their transmitters running, it is possible for the strongest transmitter to capture one or more of the receivers in the vicinity. In order to prevent this from happening the transmitter does not run continuously. A timer 55 is used to control the transmitter. It is preferably set so that the transmitter will operate at either approximately 4 or 8 second intervals.

In order to further reduce the possibility of several transmitters transmitting at the same time, the output of the master clock 57 is applied to a binary counter 59. The binary counter is offset by a signal derived from the units' bus numbers 13 over the lines 61. Using a delay signal derived from the bus number further reduces the possibility that all of the transmitters will be transmitting at the same time. The variable shift caused by the variable number selection from the bus number switch causes the output 63 of the binary counter to be applied to the encoder chip 23 at a time later than the original starting of the master clock 57.

The output of the master clock 57 is also applied to an audible alarm control 65 which is used to activate an audio device 67 such as a piezo-electric siren. The alarm device 65 is actuated by the route switch 15 over the line 69 each time the transmitter is turned on. The bus driver is reminded that the proper route must be entered by the sounding of the audio device. The audible alarm is also driven by the all-zero detector 29 over the line 71 when a bus number of 00 or higher than 80 is entered into the bus number switches 13.

The transmitter uses the electrical system 80 of the bus for power. A fuse 81 protects the electrical system from any faults in the transmitter. A power switch 83 is part of the bus route selection switch. When the bus route selection switch is turned, the power switch 83 is closed. A voltage regulator 85 is used to provide regulated voltage to the logic circuits and to the crystal oscillator 35. The regulator 85 is connected to a second voltage regulator 87 which provides regulated voltage to the multiplier stages in the transmitter. The power output of the transmitter is controlled by the DC level control 89 which controls the power input to the output amplifier stage 49. A pair of indicator lights 91 and 93 are used to show that the transmitter is turned on and that the transmitter is transmitting, respectively. The power-up reset 95 is used to clear the counter 59. It is also used to set the audible alarm, indicating to the operator that the route switch should be activated.

The output of the transmitter 53 can be connected through a suitable coaxial cable to an antenna mounted on the outer surface of the bus, preferably near the roof. The antenna can be either fixed or magnetically held in place on the roof of the bus.

Figure 3:
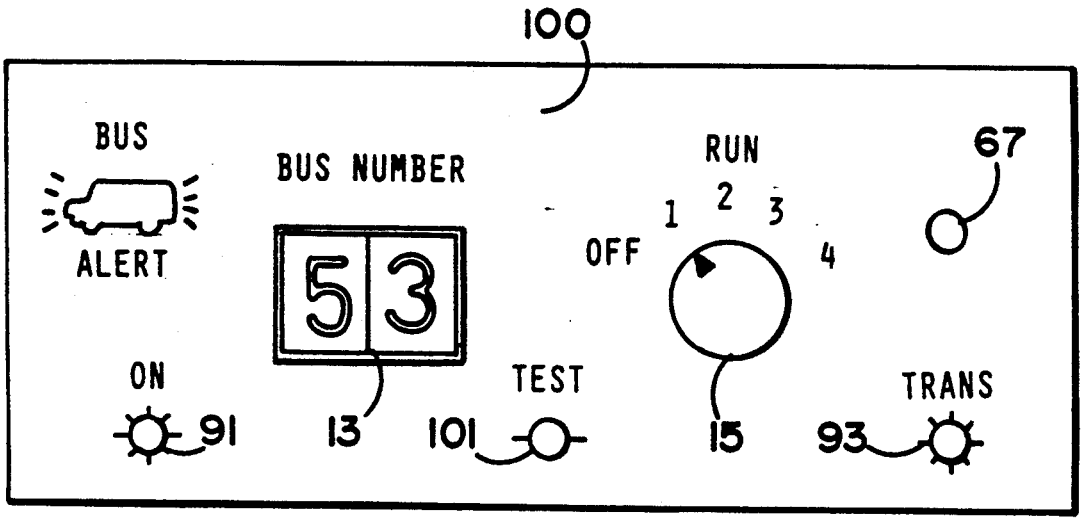
FIG. 3 is an elevational view of the face of a transmitter showing the route and bus number selection switches along with indicator lights and test switch.

From the previous discussion it can be seen that many different inputs are employed to generate the unique signal used to identify the bus. The face of the transmitter 100, however, as shown in FIG. 3 is extremely simple. The control panel has the route switch 15 which also controls the power applied to the transmitter, the indicator lights 91 and 93, which show that the transmitter is on and when it is transmitting, the bus number selection switch 13 and a small alarm or beeper 67. A test switch 101 is also on the panel and can be pressed by the bus driver to actuate the transmitter to see that it is indeed functioning before starting out on the route. The bus driver merely selects the particular route, which also turns the transmitter on, and causes the audio alarm 67 to be reset and silenced. The driver enters the proper bus number and the bus is ready to move. During the course of the day the route or run number may be changed several times by the bus driver while the bus number remains the same. If an emergency occurs and the bus must take the route or run of another bus, then the bus number can be changed to correspond to that of the bus being replaced, and the bus is then ready to go out and pick up those passengers which would have been picked up by the disabled bus. The transmitter on the bus will send out the same signal that the disabled bus would have sent out.

Figure 4:
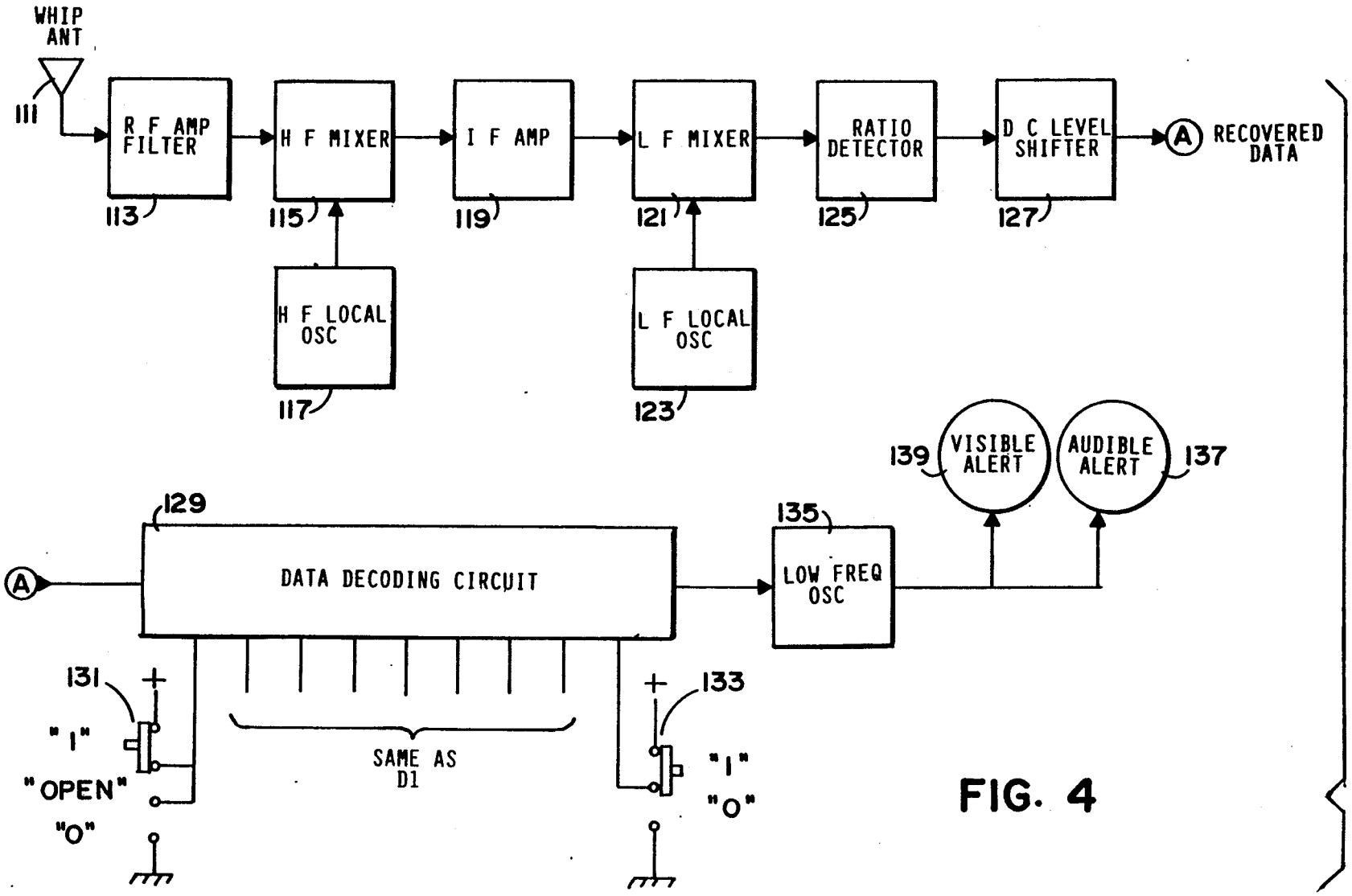
FIG. 4 is a block diagram of the receiver used with the system of the present invention.

Each home where the school children wait for the bus has a radio receiver specifically encoded to receive the matching signal transmitted by the school bus. As mentioned previously, the receiver is extremely simple to operate. The only external control is the power on/-off switch. All of the encoding switches used to set the receiver to receive a specific signal from a bus are internal to the receiver cabinet. As shown in FIG. 4, the receiver has an antenna 111 which is preferably of the collapsible type which can be telescoped into the receiver cabinet when not in use. Other antennae, such a fixed antenna or a so-called "rubber duck" antenna, can also be used.

The output of the antenna is fed to an RF amplifier and high frequency filter 113 which receives, amplifies and selects the 154.570 MHz signal. The output of the amplifier is in turn fed to a high frequency mixer 115 which also receives a signal from the local oscillator 117 to produce an intermediate frequency signal of 10.7 MHz which is sent to an IF amplifier 119. The output of the IF amplifier is then fed to a low frequency mixer 121 where it is mixed with the output from a low frequency oscillator 123 to provide a signal which is fed to a ratio detector 125. The signal emitted by the transmitter on the school bus is encoded by frequency modulation. The receiver then uses frequency modulation techniques for deriving the intelligence from the transmitted signal. The output of the ratio detector where the FM signal is demodulated, is fed through a DC level shifter 127 and then to the data decoding circuit 129, which is similar to the encoding circuit 23. The decoder uses a similar chip to that previously described for the encoding circuit using tri-state switching from a plurality of three position slide switches 131 and a single two position slide switch 133 to derive the output signal. The output signal is then fed to a low frequency oscillator 135 where it is then used to drive an audible alert device, such as a beeper. The signal can also be used to blink or cause a visible indicator 139 to become illuminated. The power source for the receiver is not shown as it can be either a battery or an internal power supply using the available house AC current through a step-down transformer, rectifier, filter and voltage regulator, as is well known.

As mentioned above, the slide switches 131 and 133 are internal to the receiver cabinet. When a receiver is issued to a parent or guardian, the slide switches are set at the school to enable the receiver to decode the specific signal transmitted by the school bus to be used to carry his or her children. With the encoding system of the present invention, the receiver should only be activated by the specific signal transmitted by the specific school bus to which the school children are assigned. Since the school bus assignments are usually made on the first day of school in the fall, the receiver can be adjusted and then sealed and distributed. The parent or guardian need only be concerned with turning the receiver on and off and not having to worry about the receiver tuning and/or sensitivity.

It can be seen from the above description that a school bus alert system is provided which can simply and economically generate a specific bus identification signal and receive that specific identification signal. The system is extremely simple to use by the bus driver in that the driver only has to be concerned with the number of the bus and the route to be driven. The parent or guardian, on the other hand, only has to be concerned with turning the receiver on to receive the unique signal transmitted by the school bus to which the children are assigned.

The present invention is not meant to be limited to the specific circuits and circuit elements disclosed. Other electronic devices can obviously be substituted to accomplish the same purposes. Also, the well known microprocessor can also be used to incorporate many of the disclosed circuit functions. While this substitution is obvious that choice was not made in order to reduce the complexity of the entire system. A keypad could be used to encode the microprocessor, however, this would add unnecessary complexity and would require the bus driver to handle a challenging task. Simplicity in operation is an important aspect of the present invention.

Likewise, the invention is not meant to be limited to school bus applications. The system is equally applicable to any situation where a person would desire to be alerted to the approach of a specific type of vehicle, or as an example and not by way of limitation, the refuse collection.

Though the invention has been described with respect to a specific preferred embodiment thereof, many variations and modifications will become apparent to those skilled in the art. It is therefore the intention that the appended claims will be interpreted as broadly as possible in view of the prior art to include all such variations and modifications.

The embodiments of the invention in which an exclusive property privilege is claimed are defined as follows.

We claim:

1. A system for alerting a bus passenger that a particular bus is approaching and that it is time for the passenger to prepare to meet the bus comprising:

a bus;

a transmitter on said bus for sending out a specific bus identification signal derived from district, route and bus identification input data entered into the transmitter by the bus driver before the bus starts out on its route;

said transmitter comprising a signal generator having a plurality of switches for entering district, route and bus number information respectively, said signal generator further including an encoder circuit for generating said specific bus identification signal;

a receiver, which has been preadjusted to receive said specific bus identification signal, for detecting said specific bus identification signal transmitted by said bus when said bus has reached the location along its route where the signal strength of said transmitted signal is sufficiently strong to cause said receiver to detect said signal and provide a passenger alerting signal so that passengers scheduled to ride that particular bus can prepare to meet said bus; wherein said transmitter broadcasts an intermittent signal to limit the possibility of receiver capture; wherein actuation of said encoder circuit in said signal generator is delayed by a variable amount determined by the bus number information switch.

2. A system for alerting a passenger as described in claim 1 wherein said receiver can only be turned on and off when needed with all other adjustment being inaccessible to the user.

3. A system for alerting a passenger as described in claim 1 wherein said specific bus identification signal does not change, after having been preset before the bus started out on its route, as said bus proceeds to pick up passengers along its route.

* * * * *